US009468959B2

(12) United States Patent
Hirase et al.

(10) Patent No.: US 9,468,959 B2
(45) Date of Patent: Oct. 18, 2016

(54) PRODUCTION METHOD OF SEAMLESS TUBE USING ROUND BAR MADE OF HIGH CR-HIGH NI ALLOY

(75) Inventors: Naoya Hirase, Tokyo (JP); Takanori Satou, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 538 days.

(21) Appl. No.: 13/996,157

(22) PCT Filed: Dec. 20, 2011

(86) PCT No.: PCT/JP2011/007098
§ 371 (c)(1),
(2), (4) Date: Jun. 20, 2013

(87) PCT Pub. No.: WO2012/086179
PCT Pub. Date: Jun. 28, 2012

(65) Prior Publication Data

US 2013/0263436 A1 Oct. 10, 2013

(30) Foreign Application Priority Data

Dec. 22, 2010 (JP) ..... 2010-285738

(51) Int. Cl.
*B21B 1/04* (2006.01)
*B21B 19/04* (2006.01)
(Continued)

(52) U.S. Cl.
CPC ..... *B21B 1/04* (2013.01); *B21B 1/026* (2013.01); *B21B 19/04* (2013.01); *C21D 9/0075* (2013.01);
(Continued)

(58) Field of Classification Search
CPC ..... B21B 1/026; B21B 1/04; B21B 3/02; B21B 19/04; B21B 23/00; B21B 2001/022; B21B 2261/10; B21B 2261/08; B21B 2261/06; C22C 19/055; C22C 30/00; C22C 38/001; C22C 38/002; C22C 38/02; C22C 38/04; C22C 38/08; C22C 38/20; C22C 38/22; C22C 38/42; C22C 38/44; C22C 38/58; C22F 1/10; C21D 9/0075; C21D 9/0081; C21D 9/08; B22D 11/006; Y10T 29/49991
See application file for complete search history.

(56) References Cited

U.S. PATENT DOCUMENTS 5,859,124 A * 1/1999 Yorifuji ..... B21B 45/0242 508/143

(Continued)

FOREIGN PATENT DOCUMENTS

CN 101605616 12/2009
JP 61-140301 6/1986

(Continued)

OTHER PUBLICATIONS

Machine Translation of JP2007-160363.*

*Primary Examiner* — Christopher M Koehler
(74) *Attorney, Agent, or Firm* — Clark & Brody

(57) ABSTRACT

A continuously cast slab with a rectangular cross section, and made of high alloy containing Cr of 20 to 30 mass %, Ni of 30 to 50 mass %, and at least one of Mo and W as Mo+0.5W of 1.5 mass % or more is subjected to blooming and billet-making to yield a round bar having a diameter of 150 to 400 mm as a starting material of the seamless tube. The blooming and billet-making process is performed under a condition satisfying a relation of $1.3 \leq H/D \leq 1.8$ where a short side length of the cross section of the cast slab is defined as H (mm), and the diameter of the round bar is defined as D (mm). The round bar is pierced-rolled to make a hollow blank; the hollow blank tube is elongation-rolled, and then diameter-adjusting-rolled to make the seamless tube, thereby preventing end cracking during piercing-rolling, and increasing yield.

2 Claims, 1 Drawing Sheet

(a) H/D=1.07 (H:390mm, D:365mm)

(b) H/D=1.30 (H:475mm, D:365mm)

(51) Int. Cl.

| | |
|---|---|
| ***C21D 9/00*** | (2006.01) |
| ***C21D 9/08*** | (2006.01) |
| ***C22C 30/00*** | (2006.01) |
| ***C22C 19/05*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/58*** | (2006.01) |
| ***C22F 1/10*** | (2006.01) |
| ***B21B 1/02*** | (2006.01) |
| *B21B 3/02* | (2006.01) |
| *B22D 11/00* | (2006.01) |
| *B21B 23/00* | (2006.01) |

(52) U.S. Cl.

CPC ..... *C21D 9/0081* (2013.01); *C21D 9/08* (2013.01); *C22C 19/055* (2013.01); *C22C 30/00* (2013.01); *C22C 38/001* (2013.01); *C22C 38/002* (2013.01); *C22C 38/02* (2013.01); *C22C 38/04* (2013.01); *C22C 38/42* (2013.01); *C22C 38/44* (2013.01); *C22C 38/58* (2013.01); *C22F 1/10* (2013.01); *B21B 3/02* (2013.01); *B21B 23/00* (2013.01); *B21B 2001/022* (2013.01); *B21B 2261/06* (2013.01); *B21B 2261/08* (2013.01); *B21B 2261/10* (2013.01); *B22D 11/006* (2013.01); *Y10T 29/49991* (2015.01)

(56) References Cited

U.S. PATENT DOCUMENTS

| | | | | |
|---|---|---|---|---|
| 2007/0157694 | A1* | 7/2007 | Okui | B21C 3/04 72/253.1 |
| 2007/0175547 | A1* | 8/2007 | Igarashi | C21D 8/10 148/442 |
| 2008/0257459 | A1* | 10/2008 | Arai | C21D 8/10 148/593 |

FOREIGN PATENT DOCUMENTS

| | | |
|---|---|---|
| JP | 4-224659 | 8/1992 |
| JP | 2007-160363 | 6/2007 |
| JP | 2008-161906 | 7/2008 |
| JP | 2009-248112 | 10/2009 |

* cited by examiner (a) H/D=1.07 (H:390mm, D:365mm)
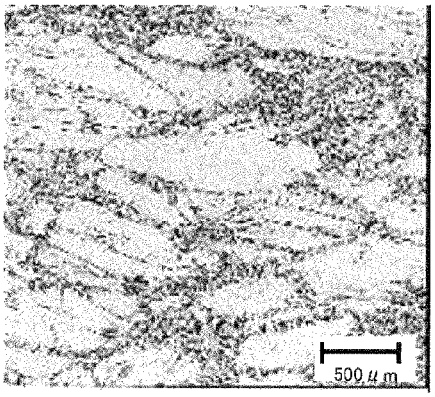
(b) H/D=1.30 (H:475mm, D:365mm)
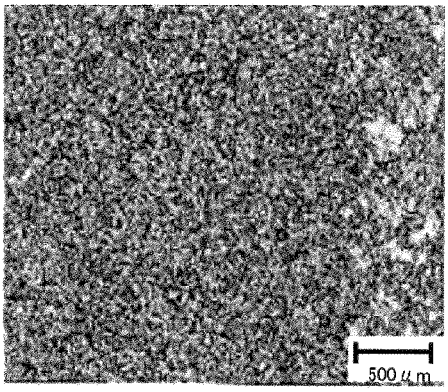

PRODUCTION METHOD OF SEAMLESS TUBE USING ROUND BAR MADE OF HIGH CR-HIGH NI ALLOY

TECHNICAL FIELD

The present invention relates to a production method of a round bar (also referred to as a "round billet", hereinafter) that is a starting material of a seamless tube made of high Cr-high Ni alloy, and to a production method of a seamless tube using the round bar.

BACKGROUND ART

In recent years, usage environment for oil well tubes and boiler tubes, etc., has become increasingly hostile. This has led to a higher level of requisite properties of seamless tubes for use in these tubes. For example, higher strength and more excellent corrosion resistance are required in oil well tubes for use in oil wells that tend to be deeper and more corrosive. Tubes for use in nuclear power generation facilities and chemical plants are required to be excellent in corrosion resistance, particularly in stress corrosion cracking resistance in the environment where these tubes are exposed to high-temperature water including high-temperature pure water and chlorine ions ($Cl^-$). In order to satisfy these requirements, more of seamless tubes made of high Cr-high Ni alloy (also referred to as simply "high alloy", hereinafter) containing large amounts of Cr, Ni, and Mo have been used as oil well tubes and the like.

High alloy seamless tubes may be produced with Mannesmann tube-making process such as a Mannesmann-mandrel mill process, a Mannesmann plug mill process, and a Mannesmann assel mill process. These tube making processes include the following steps:

(1) piercing-rolling a round billet heated at a predetermined temperature into a hollow blank (hollow shell) through a piercing mill (piercer);

(2) elongation-rolling the hollow blank through an elongation-rolling mill (e.g. mandrel mill, plug mill); and (3) diameter-adjusting-rolling the elongation-rolled blank through a diameter-adjusting-rolling mill (e.g. sizer, stretch reducer) into a finished tube having a predetermined outer diameter and wall thickness.

Round billets for use in the manufacture of high alloy seamless tubes are produced by casting molten alloy whose chemical composition is appropriately adjusted in a melting process into cast slab with a rectangular cross section in a continuous casting process, and rolling the continuously cast slab to the round bar with a desired diameter by using grooved rolls in a blooming and billet-making process.

A high Cr-high Ni alloy has deformation resistance approximately 2.4 times as high as that of carbon steel, and approximately twice as high as that of 13% Cr steel or BBS steel, for example, and thus processing-incurred heat is significantly generated, resulted from shearing deformation due to hot working. A high alloy round billet is subjected to larger shearing deformation at its both ends than that at its central portion during piercing-rolling the high alloy round billet. Hence, during piercing-rolling, while the both ends of the high alloy billet are subjected to larger shearing deformation, and at the same time, significant processing-incurred heat is generated there, resulting in great increase in temperature of the billet. Consequently, such a high alloy hollow blank produced through the piercing-rolling is likely to have grain boundary melting cracking (referred to as "tube end cracking", hereinafter) in a circumferential direction at the ends of the tube.

The tube end cracking also extends in a tube axis direction within the wall of the hollow blank, and the cracking remaining in the wall is further elongated in a tube axis direction in the subsequent elongation-rolling process and diameter-adjusting-rolling process, which results in product defective. In a hollow blank having the tube end cracking, the end of the hollow blank where the cracking exists needs to be cut off as a defective portion. As a result, defective portions to be removed from products are increased, which decreases a product yield, resulting in deterioration of the production cost.

It has been ardently desired to prevent tube end cracking from being generated during piercing-rolling in the production of a seamless tube of high Cr-high Ni alloy. Increase in temperature at the billet end portions due to processing-incurred heat during piercing-rolling is one of causes to generate the tube end cracking; thus, to satisfy the desire, such a solution can be considered that piercing-rolls the billet at a temperature lowered in advance, thereby suppressing melting in crystal grain boundaries at the end portions of the billet. Decrease in heating temperature of the billet, however, may arouse such a problem that deformation resistance of the billet be increased, which may increase load onto the piercing mill, and cause troubles in the operation. Hence, the solution to decrease the heating temperature of the billet is not practical in the case of rolling a high alloy billet.

The prior art pertinent to these facts is as follows.

Patent Literature 1 discloses a technique of focusing on outer surface flaws generated during a billet-making process where a continuously cast slab is subjected to a blooming and rolling process to yield a round billet, in production of a seamless tube for a bearing made of high-carbon chromium steel containing C of 0.7 to 1.5 mass % and Cr of 0.9 to 2.0 mass %, and employing a solution to prevent occurrence of such outer surface flaws, thereby producing a seamless tube excellent in surface quality. The technique disclosed in this Patent Literature is directed to rolling of high-carbon chromium steel, and performs blooming and billet-making under a condition that specifies a relation among a long side length W (mm) and a short side length H (mm) of a cross section of a cast slab, and a diameter D (mm) of a round billet.

Patent Literature 2 discloses a technique of focusing on inner surface flaws of a seamless tube caused by δ-ferrite produced in a central segregation of a continuously cast slab, in production of a seamless tube of 13% Cr steel (martensite-based stainless steel), and employing a solution to prevent occurrence of the inner surface flaws. The technique disclosed this Patent Literature is directed to rolling of 13% Cr steel, and specifies a chemical composition of this steel, specifies a heating temperature of a billet during piercing-rolling, and also specifies a flatness ratio (long side length/short side length of cross section) of the cast slab to be 1.8 or more.

CITATION LIST

Patent Literature

Patent Literature 1: Japanese Patent Application Publication No. 2007-160363

Patent Literature 2: Japanese Patent Application Publication No. 04-224659

SUMMARY OF INVENTION

Technical Problem

As mentioned above, the technique disclosed in Patent Literature 1 focuses on the outer surface flaws of the billet made of high-carbon chromium steel. The technique disclosed in Patent Literature 2 focuses on the inner surface flaws of the seamless tube made of 13% Cr steel. Specifically, both the techniques disclosed in Patent Literature 1 and Patent Literature 2 are directed to steel types completely different in the chemical composition and characteristics from those of high Cr-high Ni alloy, and they do not focus on the tube end cracking generated during piercing-rolling a high Cr-high Ni alloy billet at all. Hence, either the technique of Patent Literature 1 or the technique of Patent Literature 2 cannot be a solution to prevent the tube end cracking during piercing-rolling the billet of high Cr-high Ni alloy.

An objective of the present invention is to provide a production method of a round bar for a seamless tube that is used in production of a seamless tube made of high Cr-high Ni alloy, and has the following characteristics, and also to provide a production method of a seamless tube using this round bar:

(1) preventing the tube end cracking during piercing-rolling; and (2) producing the seamless tubes in high yields.

Solution to Problem

The summaries of the present invention are as follows.

(I) A production method of a round bar for a seamless tube in which a continuously cast slab with a rectangular cross section, and made of high Cr-high Ni alloy containing Cr of 20 to 30 mass %, Ni of 30 to 50 mass %, and at least one of Mo and W as Mo+0.5W of 1.5 to 10 mass % is subjected to a blooming and billet-making process to yield a round bar having a diameter of 150 to 400 mm as a starting material of the seamless tube, the method being characterized in that the blooming and billet-making process is carried out under a condition satisfying a relation of $1.3 \leq H/D \leq 1.8$ where a short side length of the cross section of the cast slab is defined as H (mm), and the diameter of the round bar is defined as D (mm).

(II) A production method of a seamless tube with a Mannesmann tube-making process, characterized in that the round bar according to (I) is subjected to a piercing-rolling process through a piercing mill to yield a hollow blank, and the hollow blank is subjected to a elongation-rolling process through an elongation-rolling mill; followed by a diameter-adjusting-rolling process through a diameter-adjusting-rolling mill.

Advantageous Effects of Invention

The production method of a round bar for a seamless tube of the present invention has the following significant effects:

(1) it is possible to prevent the tube end cracking from being generated during piercing-rolling even in production of the seamless tube of high Cr-high Ni alloy; and (2) it is possible to produce seamless tubes made of high Cr-high Ni alloy in high yields while suppressing the loss of defective portions resulted from occurrence of the tube end cracking.

The excellent effect of the production method of the round bar of the seamless tube of the present invention can be sufficiently attained in the production method of the seamless tube of the present invention.

BRIEF DESCRIPTION OF DRAWINGS

FIG. 1 shows an example of a cross sectional microstructure in a near-surface portion of a high Cr-high Ni alloy billet, FIG. 1(*a*) shows a representative example in a case of H/D, i.e., the ratio of short side length H of cast slab cross section to billet diameter D, of less than 1.3, and FIG. 1(*b*) shows a representative example in a case of H/D of 1.3 or more, respectively.

DESCRIPTION OF EMBODIMENT

In order to achieve the aforementioned objective, the present inventors have conducted various tests and studied based on the premise that a round billet is formed through a blooming and billet-making process using a continuously cast slab with a rectangular cross section, as a starting material in production of a seamless tube made of high Cr-high Ni alloy with a Mannesmann tube-making method.

Specifically, as verified in Example later, continuously cast slabs of high Cr-high Ni alloy with various cross sectional dimensions (short side lengths, long side lengths) were bloomed and rolled into round billets having various diameters, and an inspection for examining the presence or absence of the tube end cracking was conducted on every billet after piercing-rolled through a piercing mill. As a result of this inspection, it was found that the tube end cracking was generated on billets having H/D of less than 1.3 during piercing-rolling, and no tube end cracking was generated on billets having H/D of 1.3 or more during piercing-rolling, where the short length of cross section of each cast slab was defined as H (mm), and the diameter of each billet was defined as D (mm).

In this way, it has been found that no tube end cracking is generated if the condition of $1.3 \leq H/D$ is satisfied; and in order to study how this phenomenon occurred, a specimen was collected from an end portion of every billet produced under the same billet-making condition among the billets used in the above piercing-rolling test, and cross-sectional microstructure observation was conducted for a near outer layer portion at a depth of 2.5 mm from the outer circumference of each specimen.

FIG. 1 shows an example of a cross sectional microstructure in a near-surface portion of a high Cr-high Ni alloy billet; FIG. 1(*a*) shows a representative example in a case of H/D, i.e., the ratio of short side length H of cast slab cross section to billet diameter D, of less than 1.3, and FIG. 1(*b*) shows a representative example in a case of H/D of 1.3 or more, respectively. As shown in FIG. 1(*a*), it can be seen that the billet made under the condition of H/D of less than 1.3 exhibits a crystal structure of a mixed structure including fine grains and coarse grains. On the other hand, as shown in FIG. 1(*b*), it can be seen that, in the billet made under the condition of H/D of 1.3 or more, the reduction rate for deforming the cast slab in the direction parallel to its short side becomes relatively high during the blooming and billet-making process, and thus the crystal structure of the billet becomes a fine-grain uniform microstructure.

The billet made under the condition of H/D of less than 1.3 shown in FIG. 1(*a*) has the crystal structure of the mixed structure including fine grains and coarse grains, and impurities such as P are concentrated in the crystal grain boundaries having a greater coarse diameter, and the concentrated impurities fuel the lowering of the melting point of the crystal grain boundaries. Based on this, it can be explained that, in the billet made under the condition of H/D of less than 1.3, melting likely occurs in the crystal grain boundaries due to processing-incurred heat during piercing-rolling, so that the tube end cracking is generated at both ends of the billet where shearing deformation becomes greater. On the other hand, the billet made under the condition of H/D of 1.3 or more shown in FIG. 1(*b*) has the crystal structure of a uniform fine-grain microstructure, so that impurities are dispersed in the uniform fine crystal grain boundaries, which suppresses the lowering of the melting point of the crystal grain boundaries. Based on this, it can be explained that, in the billet made under the condition of H/D of 1.3 or more, melting unlikely occurs in the crystal grain boundaries even if processing-incurred heat is generated during piercing-rolling, and thus the tube end cracking is prevented.

Note that, excessively great H/D causes a significantly great reduction rate during blooming and billet-making, which results in significant rolling wrinkles on the surface of the billet, deterioration of the shape of the billet end portions, and increase in discard from the billet. Accordingly, H/D is limited to be 1.8 or less.

As aforementioned, the present invention has been made based on the finding that, in production of the seamless tube of high Cr-high Ni alloy, no tube end cracking is generated in such a billet that satisfies the condition of $1.3 \leq H/D \leq 1.8$ during piercing-rolled. The production method of the round bar for the seamless tube of the present invention, as described above, in which a continuously cast slab with a rectangular cross section, and made of high Cr-high Ni alloy containing Cr of 20 to 30 mass %, Ni of 30 to 50 mass %, and at least one of Mo and W as Mo+0.5W of 1.5 to 10 mass % is subjected to a blooming and billet-making process to yield a round bar having a diameter of 150 to 400 mm as a starting material of the seamless tube, is characterized in that the blooming and billet-making process is carried out under the condition satisfying the relation of $1.3 \leq H/D \leq 1.8$, where the short side length of the cross section of the cast slab is defined as H (mm), and the diameter of the round bar is defined as D (mm).

The production method of the seamless tube of the present invention includes piercing-rolling the above described round bar through a piercing mill into a hollow blank, elongation-rolling the hollow blank through an elongation-rolling mill, and further diameter-adjusting-rolling this hollow blank through a diameter-adjusting-rolling mill.

A description will be given of the reasons for specifying the production method of the present invention as aforementioned, and on a preferable embodiment of the production method of the present invention, hereinafter.

1. Chemical Composition of High Cr-High Ni Alloy

A specific composition of the high Cr-high Ni alloy employed in the present invention is as follows. The symbol "%" of an element content denotes "mass %" in the following description.

Cr: 20 to 30%

Cr is an element effective to enhance hydrogen sulfide corrosion resistance represented by stress corrosion cracking resistance in coexistence with Ni. However, the Cr content of less than 20% cannot achieve this effect. On the other hand, the Cr content of more than 30% saturates the effect, which is not preferable in light of hot workability. Hence, the appropriate Cr content is set to be within a range of 20 to 30%.

Ni: 30 to 50%

Ni is an element having an effect of enhancing hydrogen sulfide corrosion resistance. The Ni content of less that 30%, however, insufficiently forms a Ni sulfide film on the outer surface of the alloy, and consequently any effect by containing Ni cannot be attained. On the other hand, the Ni content of more than 50% rather saturates the effect, and any effect commensurate with the alloy cost cannot be attained, which hinders economic efficiency. Accordingly, the appropriate Ni content is within a range of 30 to 50%.

Mo+0.5W: 1.5 to 10%

Mo and W each have an effect of improving pitting resistance, and either or both of them may be added. The content as "Mo+0.5W" of less than 1.5% cannot achieve the effect, and thus the content as "Mo+0.5W" is set to be 1.5% or more. Containing these elements more than necessary only saturates the effect, and the excessive content rather deteriorates hot workability. Accordingly, the content is set such that a value of "Mo+0.5W" is within a range of 10% or less.

The high Cr-high Ni alloy employed in the present invention may contain the following elements other than the above alloy elements.

C: 0.04% or less

C combines with Cr, Mo, Fe and the like to form carbide, and increase in the C content deteriorates ductility and toughness. Accordingly, it is preferable to limit the C content to be 0.04% or less.

Si: 0.5% or less

Si prevents the formation of r phase, and suppresses the deterioration of ductility and toughness, and thus the Si content is preferably set to be as small as possible. Accordingly, it is preferable to limit the Si content to be 0.5% or less.

Mn: 0.01 to 3.0%

Mn contributes to the enhancement of hot workability. Hence, the Mn content is preferably set to be 0.01% or more. The excessive Mn content may deteriorate corrosion resistance, and thus the Mn content is preferable set to be 3.0% or less. Accordingly, the Mn content is preferably set to be within a range from 0.01 to 3.0% if Mn is added. Particularly, it is preferable to set the Mn content to be 0.01 to 1.0% if the formation of the a phase causes a problem.

P: 0.03% or less

P is usually contained in alloy as an impurity, and is an element causing adverse influences on hot workability and the like. P is accumulated in the crystal grain boundaries, may encourage the tube end cracking depending on the degree of the accumulation, and thus the P content is preferably set to be less. Accordingly, it is preferable to limit the P content to be 0.03% or less.

S: 0.03% or less

S is also contained in alloy as an impurity, and an element causing adverse influences on toughness and the like. S is also accumulated in the crystal grain boundaries, may accelerate the tube end cracking depending on the degree of the accumulation, and thus the S content is preferably set to be less. Accordingly, it is preferable to limit the S content to be 0.03% or less.

Cu: 0.01 to 1.5%

Cu is an element effective to enhance creep rupture strength, and the Cu content is preferably set to be 0.01% or more. The Cu content of more than 1.5% may rather deteriorate ductility of the alloy. Accordingly, it is preferable to set the Cu content to be within a range from 0.01 to 1.5%.

Al: 0.20% or less

Al is effective as a deoxidizer, but encourages formation of intermetallic compound such as a phase, and thus the Al content is preferably limited to be 0.20% or less.

N: 0.0005 to 0.2%

N is a solid-solution strengthening element, and contributes to high-strengthening, and also suppresses formation of intermetallic compound such as a phase, which contributes to enhancement of toughness. Hence, the N content is preferably set to be 0.0005% or more. The N content of more than 0.2% rather deteriorates pitting resistance. Accordingly, it is preferable to set the N content to be within a range of 0.0005 to 0.2%.

Ca: 0.005% or less

Ca immobilizes S that hinders hot workability as sulfide, but the excessive Ca content rather deteriorates hot workability. Accordingly, the Ca content is preferably limited to be 0.005% or less.

2. Condition for Producing Seamless Tube

The seamless tube of high Cr-high Ni alloy of the present invention is a tube made of high alloy that contains the aforementioned essential elements, and further may contain optional elements to be added if necessary, the balance being Fe and impurities. This seamless tube may be produced in production facilities with production methods conventionally used in the industrial field. For example, an electric arc furnace, an argon oxygen decarburization furnace (argon-oxygen mixture bottom blowing decarburization, AOD furnace), or a vacuum oxygen decarburization furnace (VOD furnace) may be used for melting the high alloy.

Molten metal having the above chemical composition is casted into a cast slab with a rectangular cross section by means of the continuous casting process, and this continuously cast slab is subjected to a blooming and billet-making process to yield a round billet with a circular cross section through grooved rolls. This round billet can be used as starting material for producing a high alloy seamless tube with the Mannesmann tube-making process, that is, this round billet is piercing-rolled through the piercing mill into a hollow blank, and this hollow blank is elongation-rolled through the elongation-rolling mill, and then is diameter-adjusting-rolled through the diameter-adjusting-rolling mill into the high alloy seamless tube.

In the production of the high alloy seamless tube of the present invention, the continuously cast slab is subjected to a blooming and billet-making process to yield the round billet with a diameter of 150 to 400 mm. The reason for this is because, in the case of producing a high alloy seamless tube, a round billet having a diameter within a range of 150 to 400 mm is commonly employed as a starting material thereof, and thus any billet having a diameter within this range is sufficiently practical.

At this time, the blooming and billet-making process for the cast slab is carried out under the condition satisfying a relation of $1.3 \leq H/D \leq 1.8$ where the short side length of the cross section of the cast slab is defined as H (mm), and the diameter of the round billet is defined as D (mm). This is because of the following reasons. H/D of 1.3 or more means that the reduction rate for deforming the cast slab in the direction parallel to its short side becomes relatively high during the blooming and billet-making process, and thus the crystal structure of the billet becomes a fine-grain and uniform microstructure, and the impurities such as P are dispersed in the uniform fine crystal grain boundaries. Consequently, lowering the melting point of the crystal grain boundaries is suppressed, and melting unlikely occurs in the crystal grain boundaries even if processing-incurred heat is generated due to shearing deformation at the both ends of the billet during piercing-rolling, thereby preventing the tube end cracking resulted from the melting in the grain boundaries. On the other hand, H/D of more than 1.8 causes significant rolling wrinkles on the surface of the billet during the blooming and billet-making process, and also the distortion of the shape at the billet end portions, which results in increase in discard amount from the billet.

In piercing-rolling, the heating temperature of the billet is preferably within a range of 1150 to 1250° C. If the heating temperature is decreased to less than 1150° C., deformation resistance of the billet is increased, which causes increase in load onto the piercing mill, resulting in hindrance of the operation. On the other hand, the heating temperature of more than 1250° C. together with the processing-incurred heat may cause the tube end cracking resulted from the melting in the grain boundaries.

As described above, according to the production method of the round bar for the seamless tube of the present invention, it is possible to produce the round bar of high Cr-high Ni alloy in which prevention of the tube end cracking can be attained by appropriately adjusting the blooming and billet-making condition defined by the short side length of the continuously cast slab cross section and the diameter of the round bar without decreasing the heating temperature of the round bar during piercing-rolling. Accordingly, in the production method of the seamless tube of the present invention using this round bar, it is possible to achieve the excellent effect of the production method of the round bar for the seamless tube of the present invention, and it is also possible to suppress loss as defective portions due to occurrence of the tube end cracking, thereby producing the seamless tubes of high Cr-high Ni alloy in preferable yields.

Example

In order to confirm the effect of the present invention, as shown in Table 1 below, a full scale test was conducted such that continuously cast slabs of high Cr-high Ni alloy having various cross sectional dimensions (short side lengths H, long side lengths W) were subjected to a blooming and billet-making process to yield round billets having various diameters D, and each billet was piercing-rolled through a piercing mill. In addition, visual observation was conducted on both end surfaces of each of the obtained hollow blanks, so as to examine the presence or absence of the tube end cracking thereon. Results of the examination and the evaluation thereof were shown in Table 1 below.

TABLE 1

| | Cast Slab | | | | | |
|---|---|---|---|---|---|---|
| No. | Short Side Length H[mm] | Long Side Length W[mm] | Billet Diameter D[mm] | H/D | Tube End Cracking (Yes/No) | Evaluation |
| 1 | 390 | 700 | 365 | 1.07* | Yes | X |
| 2 | 390 | 700 | 310 | 1.26* | Yes | X |
| 3 | 390 | 700 | 225 | 1.73 | No | ○ |
| 4 | 475 | 475 | 365 | 1.30 | No | ○ |
| 5 | 280 | 600 | 225 | 1.24* | Yes | X |
| 6 | 280 | 600 | 191 | 1.47 | No | ○ |
| 7 | 280 | 600 | 178 | 1.57 | No | ○ |

Note:

*represents deviation from condition specified by the present invention.

Symbols in the "Evaluation" column of Table 1 denote as follows.

○: "Good" represents that no tube end cracking was confirmed.

x: "Poor" represents that the tube end cracking was confirmed.

In addition to the above piercing-rolling test, a specimen was collected from an end portion of each billet for Test No. 1 to Test No. 7 shown in Table 1, and observation of the cross sectional microstructure was conducted for an outer layer portion at a depth of 2.5 mm from the outer circumference of each specimen. As representative examples of the observation result, the cross sectional microstructure of the billet for Test No. 1 is shown in FIG. 1(*a*), and the cross sectional microstructure of the billet for Test No. 4 is shown in FIG. 1(*b*).

The results of Table 1 and FIG. 1 reveal the following.

As shown in Table 1, the specimens for Test Nos. 3, 4, 6 and 7 satisfied the blooming and billet-making condition ($1.3 \leq H/D \leq 1.8$) specified by the present invention, and had no tube end cracking. As shown in Test No. 4 of FIG. 1(*b*), the crystal structure of the billet was a fine-grain and uniform microstructure, and impurities were dispersed in the uniform fine crystal grain boundaries, so that melting unlikely occurred in the crystal grain boundaries even if processing-incurred heat was generated during piercing-rolling.

On the other hand, all the specimens for Test Nos. 1, 2 and 5 did not satisfy the blooming and billet-making condition specified by the present invention, and they all had the tube end cracking. As shown in Test No. 1 of FIG. 1(*a*), because the crystal structure of the billet was a mixed structure including fine grains and coarse grains, impurities were concentrated in the crystal grain boundaries having a coarse grain diameter, and melting likely occurred in the crystal grain boundaries due to processing-incurred heat during piercing-rolling.

INDUSTRIAL APPLICABILITY

The present invention can be effectively utilized in the production method of a seamless tube of high Cr-high Ni alloy with a Mannesmann tube-making process.

What is claimed is:

1. A production method of a seamless tube with a Mannesmann tube-making process comprising:

subjecting a continuously cast slab with a rectangular cross section, and made of high Cr-high Ni alloy containing Cr of 20 to 30 mass %, Ni of 30 to 50 mass %, and at least one of Mo and W as Mo+0.5W of 1.5 to 10 mass % to a blooming and billet-making process to yield a round bar having a diameter of 150 to 400 mm;

subjecting the round bar to a piercing-rolling process through a piercing mill to yield a hollow blank; and subjecting the hollow blank to an elongation-rolling process through an elongation-rolling mill; followed by a diameter-adjusting-rolling process through a diameter-adjusting-rolling mill;

wherein the blooming and billet-making process is carried out under a condition satisfying a relation of $1.3 \leq H/D \leq 1.8$ where a short side length of the cross section of the cast slab is defined as H (mm), and the diameter of the round bar is defined as D (mm).

2. A production method of a round bar for a seamless tube comprising:

subjecting a continuously cast slab with a rectangular cross section, and made of high Cr-high Ni alloy containing Cr of 20 to 30 mass %, Ni of 30 to 50 mass %, and at least one of Mo and W as Mo+0.5W of 1.5 to 10 mass % to a blooming and billet-making process to yield a round bar having a diameter of 150 to 400 mm as a starting material of the seamless tube, wherein the blooming and billet-making process is carried out under a condition satisfying a relation of $1.3 \leq /D \leq 1.8$ where a short side length of the cross section of the cast slab is defined as H (mm), and the diameter of the round bar is defined as D (mm).

* * * * *